US007945978B2

(12) United States Patent
Brandt

(10) Patent No.: US 7,945,978 B2
(45) Date of Patent: May 24, 2011

(54) DUVET AND DUVET COVER COMBINATION

(76) Inventor: Eliza Brandt, Akersberga (SE)

( * ) Notice: Subject to any disclaimer, the term of this patent is extended or adjusted under 35 U.S.C. 154(b) by 0 days.

(21) Appl. No.: 12/595,435

(22) PCT Filed: Apr. 8, 2008

(86) PCT No.: PCT/SE2008/000252

§ 371 (c)(1),
(2), (4) Date: Oct. 9, 2009

(87) PCT Pub. No.: WO2008/127170

PCT Pub. Date: Oct. 23, 2008

(65) Prior Publication Data

US 2010/0064436 A1 Mar. 18, 2010

(30) Foreign Application Priority Data

Apr. 11, 2007 (SE) ..... 0700899

(51) Int. Cl.
*A47G 9/02* (2006.01)

(52) U.S. Cl. ..... 5/501; 5/486; 5/496

(58) Field of Classification Search ..... 5/501, 494, 5/496, 486

See application file for complete search history.

(56) References Cited

U.S. PATENT DOCUMENTS

| | | | | |
|---|---|---|---|---|
| 1,291,191 | A | 1/1919 | Semple | |
| 1,403,873 | A | 1/1922 | Scott | |
| 2,531,716 | A * | 11/1950 | Wolf | 128/873 |
| 4,441,223 | A | 4/1984 | Yang | |
| 4,653,131 | A | 3/1987 | Diehl | |
| 2002/0157184 | A1 | 10/2002 | Maturaporn | |

FOREIGN PATENT DOCUMENTS

| | | |
|---|---|---|
| DE | 8004038 | 5/1980 |
| DE | 198 12 907 | 9/1999 |
| GB | 578893 | 7/1946 |
| GB | 2 415 371 | 12/2005 |
| JP | 6-70834 | 3/1994 |
| JP | 7-155247 | 6/1995 |
| JP | 7-275102 | 10/1995 |
| JP | 2002-345615 | 12/2002 |
| WO | 03/045203 | 6/2003 |

OTHER PUBLICATIONS

International Search Report dated May 28, 2008, from corresponding PCT application.

* cited by examiner

*Primary Examiner* — Fredrick Conley
(74) *Attorney, Agent, or Firm* — Young & Thompson

(57) ABSTRACT

A duvet and duvet cover combination where the duvet is arranged to be placed inside the duvet cover, where the duvet includes an integrated substantially rectangular extension part having a first long side attached to the duvet, and a second long side divided up in two parts that are separated by an aperture which extends essentially centered and over at least half the distance between the second long side and the first long side The duvet includes straps arranged in corners of the extension part and the duvet cover includes through holes arranged in corners of the extension part. The straps are arranged to be passed through the holes on the upper side and the under side of the extension part of the duvet cover whereafter they may to be tied together to keep the extension part of the duvet safely in place inside the extension part of the duvet cover, whereby the shoulders and arms of a user may be kept warm by the extension parts.

8 Claims, 1 Drawing Sheet

DUVET AND DUVET COVER COMBINATION

TECHNICAL FIELD OF THE INVENTION

The present invention relates to a duvet and duvet cover combination according to the preamble of claim 1.

TECHNICAL BACKGROUND

According to the technical background there are a number of different duvets intended to keep a person warm when he or she sleeps. A problem has been that the duvet slips down so that shoulders and arms are exposed which causes them to cool down. This can be experienced as troublesome, especially if one has sensitive shoulders and arms.

U.S. Pat. No. 1,291,191 describes a duvet which is fastened around the neck of a little child so that the child can not kick the duvet off itself. As the duvet is fastened around the neck, it prevents cold from reaching the neck and the arms. However, this also makes it easy to feel confined.

GB Patent No. 578,893 describes a similar duvet as in U.S. Pat. No. 1,291,191, with a small difference in how the duvet is fastened around the neck. Also here, it is easy to feel confined.

U.S. Pat. No. 4,653,131 describes a duvet which by means of straps is fastened in the bed frame to hold a person who lies in the bed in place. This duvet is principally intended for holding children or senile persons in a safe way in bed during the night. For natural reasons, the duvet must then lay very tight over the body and thus markedly limits the freedom of movement of the person.

U.S. Pat. No. 4,441,223 describes a duvet which has a hole in the upper part of the duvet. The hole is adapted for to be able to pass a persons head therethrough. During use, the head will keep the duvet in place against the bed so that the duvet can not fall off the bed and the person is by that always kept warm. There is a great risk that a person who uses this duvet feels confined and limited in hers/his freedom of movement during sleep.

US Patent Application No. 2002/0157184 shows as U.S. Pat. No. 4,441,223 a duvet which has a hole in the upper part of the duvet. The only difference is the design of the hole and its placing. Also here there is a risk that a person may feel confined and limited in hers/his freedom of movement.

U.S. Pat. No. 1,403,873 describes a duvet for babies which consists of a lower part which the baby lies on and an upper part which may be folded over the baby. The upper part has an aperture for the neck and for the hands. During use, the baby is confined and has apart from the legs a limited freedom of movement.

As is evident from the known art, they all solve more or less the problem of keeping the person under the duvet warm. However, the problem with the known solutions is that they limit the freedom of movement of the person lying under the duvet, i.e. it feels a bit like being confined.

SUMMARY OF THE INVENTION

The problem which the present invention is intended to solve is to produce a duvet which is capable of holding arms and shoulders warm at the same time as a user of the duvet does not feel confined and in principle has the same freedom of movement as with an ordinary duvet.

According to a first aspect of the invention, this problem is solved with an extension part which has a first long side which is designed attacheable to a duvet or duvet cover, and a second long side which is divided up in two parts separated by an aperture which extends essentially centered and over at least half the distance between the second and the first long side. The size of the aperture corresponds essentially to or is somewhat larger than the size of a human head.

According to a second aspect of the invention, the extension part is designed integrated in one piece with the duvet or the duvet cover.

According to a third aspect of the invention, the corners of the extension part or alternatively of the duvet cover integrated with the extension part show through holes in order to be able to fasten a duvet which is inserted in the duvet cover and the extension part.

BRIEF DESCRIPTION OF THE DRAWINGS

The invention will be described in more detail by means of different embodiments of the invention with reference to the accompanying drawing. It shows FIG. 1 which shows a view from above of the extension part and the duvet.

DETAILED DESCRIPTION OF THE INVENTION

Figure 1:
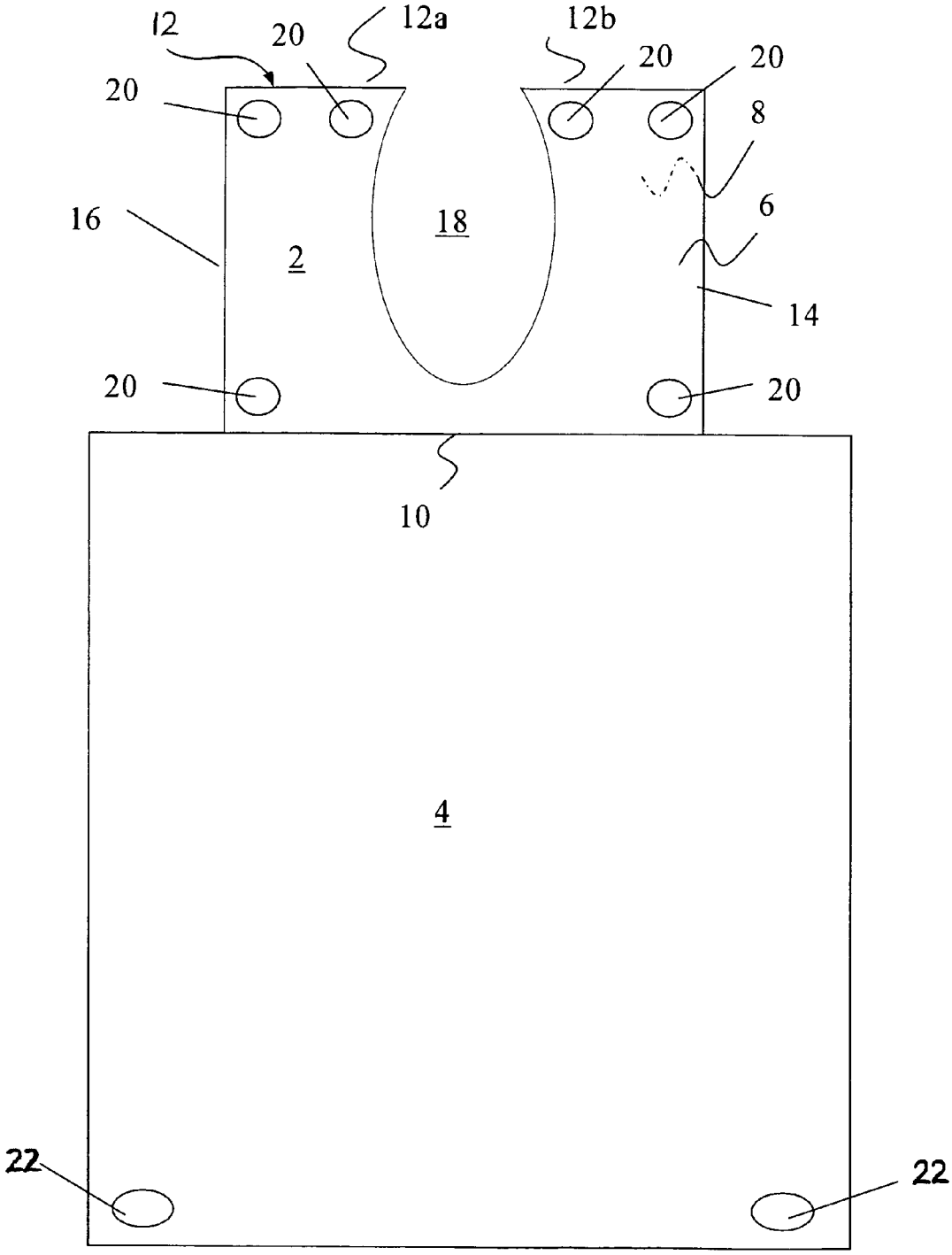

FIG. 1 shows an essentially rectangular extension part 2 for a duvet 4. The extension part has an upper side 6, an under side 8, a first long side 10, a second long side 12, a first short side 14, a second short side 16, an aperture 18 and six through holes 20. Also the duvet 4 shows through holes 22.

The extension part 2 may be designed as a thick duvet, or the upper side 6 and the under side 8 may be two separate pieces which are sewn together. However, they are not completely sewn together but have an opening in one of the sides 10-16 in order to be able to insert a duvet. The extension part 2 then has the same function as a duvet cover. In order for the duvet not to slide around inside the extension part 2, through holes 20 are arranged in the corners of the extension part 2. Through these holes 20 one can pass out straps or strings that are arranged on the duvet through the upper side 6 and the under side 8, respectively, and then tie them together. In a further embodiment, four holes are arranged along the second long side 12. In this way, the duvet lies safely in place inside the extension part 2. In that embodiment where the extension part 2 is a thick duvet, the through holes may be omitted.

By duvet is also duvet cover referred to in the following. The second long side 12 of the extension part 2 is divided up in two parts 12*a* and 12*b*. These parts 12*a*, 12*b* are separated by an aperture 18 that extends essentially centered and over at least half the distance between the second long side 12 and the first long side 10. The aperture 18 has a size which corresponds to or is somewhat larger than the head of a human. In a preferred embodiment, the aperture 18 is essentially oval shaped. By this aperture 18, it is possible to feel that the head has a large freedom of movement as the aperture 18 is open at the second long side 12, at the same time as the extension part 2 guarantees that the shoulders and the arms are kept warm. The freedom of movement for the rest of the body is not affected by the present invention but is in corresponding way as for an ordinary duvet 4.

The first long side 10 is provided with fastening devices, not shown closer, in order to be able to be attached to an ordinary duvet or duvet cover 4. The fastening devices may e.g. be velcro fastenings, tapes or strings arranged on the extension part 2 and the duvet or duvet cover 4 to attach these together. In another embodiment of the invention, the duvet or the duvet cover 4 and the extension part 2 may be attached together with a zip fastener. However, in a preferred embodiment of the invention, the extension part 2 is designed integrated in one piece with the duvet or duvet cover 4. In this case, simply the upper side 6 of the extension part is sewn together with the upper part of the duvet or duvet cover 4, and the lower side 8 of the extension part 2 with the lower side of the duvet or duvet cover 4. In this embodiment, the holes 20 in the extension part 2 that lie closest to the first long side are omitted and are instead replaced by holes 22 arranged at the foot-end of the duvet 4. This means that a duvet lies safely in place inside the integrated extension part 2 and the duvet cover 4 as described above.

As mentioned, the extension part 2 is essentially rectangular. This shall be interpreted broadly which means that it may be square, have rounded corners etc. In a preferred embodiment, the length of the long side 10 of the extension part 2 corresponds to, or is somewhat larger than, the width of the bed in which it will be used. This makes it possible to easily fold away the extension part 2 when one does not want to use it in that embodiment where the extension part 2 is integrated in one piece with the duvet or duvet cover 4.

Different embodiments of the invention have now been described, but it is to be understood that there are further variants that lie within the scope for the person skilled in the art to execute. The present invention shall therefore not only be limited by the embodiments shown but only by the attached claims.

The invention claimed is:

1. A duvet and duvet cover combination, comprising:

a duvet (4) comprised of an essentially rectangular duvet part with a top edge and a bottom edge and with through holes (22) located in as least two corners of the rectangular duvet part along the bottom edge; and a duvet cover comprised of an essentially rectangular extension part (2) having four corners, an upper side (6), an under side (8), a first long side (10), a second long side (12), a first short side (14), a second short side (16), an oval-shaped aperture (18) and at least four through holes (20), the through holes (20) arranged at least in one of i) one through hole (20) at each of the four corners, and ii) all of the through holes located in the second long side, the through holes sized to allow passage of straps, said extension part (2) further comprised of separate sewn-together pieces with an opening in one of i) the first long side (10), ii) the second long side (12), iii) the first short side (14), and iv) the second short side (16), the opening sized for insertion of the duvet (4), said first long side (10) of said extension part (2) attached to said to edge of said rectangular duvet part as an integrated one-piece duvet and duvet cover combination, the aperture (18) centered with respect to the first long side (10), and the aperture (18) extending over at least half a distance between the first long side (10) and the second long side (12), the aperture open at the second long side (12), wherein the aperture his a perimeter including an opening between the first part (12*a*) and the second part (12*b*), said second long side (12) comprised of a first part (12*a*) and a second part (12*b*), the first part (12*a*) separated from the second part (12*b*) by the opening in the perimeter of the aperture (18).

2. A duvet and duvet cover combination, comprising:

a duvet (4) comprised of an essentially rectangular duvet part with a top edge and a bottom edge; and a duvet cover comprised of an extension part (2) having an upper side (6), an under side (8), a first long side (10), a second long side (12), a first short side (14), a second short side (16), and an aperture (18), said extension part (2) further comprised of separate sewn-together pieces and including an opening sufficient for insertion of the duvet (4), said first long side (10) of said extension part (2) attached to said top edge of said rectangular duvet part as an integrated one-piece duvet and duvet cover combination, the aperture (18) centered with respect to the first long side (10), and the aperture (18) extending over at least half a distance between the first long side (10) and the second long side (12), the aperture open at the second long side (12), wherein the aperture has a perimeter including an opening between the first part (12*a*) and the second part (12*b*), said second long side (12) comprised of a first part (12*a*) and a second part (12*b*), the first part (12*a*) separated from the second part (12*b*) by the opening in the perimeter of the aperture (18).

3. A duvet and duvet cover combination, comprising:

a duvet cover and a duvet, the duvet cover configured for receiving the duvet, the duvet arranged to be placed inside the duvet cover, wherein the duvet cover comprises an essentially rectangular extension piece (2) having corners, a first long side (10), a second long side (2), an aperture (18), an upper side (6), a underside (8), wherein the duvet (4) and duvet cover (2) comprise one piece, the duvet (4) integrated with the first long side (10) of the extension part (2), wherein the second long side (12) is divided into two parts (12*a*, 12*b*) that are separated by the aperture (18), wherein the aperture (18) extends essentially centered and over at least half a distance between the second long side (12) and the first long side (10), wherein the extension cart (2) comprises through holes (20) arranged in the corners of the extension part, wherein the extension part (2) comprises one of straps and strings, the one of straps and strings arranged to be passed, in use, through said holes (20) on the upper side (6) and (the underside (8) so as to be tied together so that the shoulders and arms of a user are closed by the extension part (4).

4. The duvet and duvet cover combination as claimed in claim 3, wherein the aperture has an essentially oval shape.

5. The duvet and duvet cover combination as claimed in claim 3, the aperture size corresponds to the size of a human head.

6. The duvet and duvet cover combination as claimed in claim 3, wherein the length of the long side (10) of the extension part is bed-width.

7. The duvet and duvet cover combination as claimed in claim 3, wherein, the duvet (4) further comprises straps or strings arranged at a foot-end of the duvet (4), the duvet (4) comprises through holes (22) arranged at the foot-end of the duvet (4), said straps or strings in the duvet (4) are arranged to be passed through said holes (22) on an upper side and an underside of the duvet (4) whereafter to be tied together to keep the duvet (4) in place inside the duvet cover.

8. The duvet and duvet cover combination as claimed in claim 3, wherein the duvet (4) further comprises through holes (22).

* * * * *